US007201177B2

(12) United States Patent
Anticoli et al.

(10) Patent No.: US 7,201,177 B2
(45) Date of Patent: Apr. 10, 2007

(54) PORTABLE BABY TENT

(76) Inventors: Jennifer Cobb Anticoli, 3615 Neal Pearson Rd., Tipp City, OH (US) 45371; LaVonda Lynn Chandler, 1112 Geneva Rd., Beavercreek, OH (US) 45434

( * ) Notice: Subject to any disclaimer, the term of this patent is extended or adjusted under 35 U.S.C. 154(b) by 0 days.

(21) Appl. No.: 11/111,112

(22) Filed: Apr. 21, 2005

(65) Prior Publication Data

US 2005/0236026 A1 Oct. 27, 2005

Related U.S. Application Data

(60) Provisional application No. 60/564,923, filed on Apr. 22, 2004.

(51) Int. Cl.
*E04H 15/40* (2006.01)

(52) U.S. Cl. ..... 135/125; 135/124

(58) Field of Classification Search ..... 135/116, 135/124, 125, 126, 128, 137, 120.1; 446/487
See application file for complete search history.

(56) References Cited

U.S. PATENT DOCUMENTS

| | | | | | |
|---|---|---|---|---|---|
| 1,079,757 | A | * | 11/1913 | Gould | 135/126 |
| 4,073,017 | A | | 2/1978 | Stevens | |
| 4,129,139 | A | | 12/1978 | Powers | |
| 4,491,141 | A | * | 1/1985 | Eppenbach | 135/125 |
| 4,493,120 | A | | 1/1985 | Watts | |
| 4,583,779 | A | | 4/1986 | Myers | |
| 4,723,371 | A | * | 2/1988 | Williams | 43/1 |
| 4,825,891 | A | * | 5/1989 | Machado | 135/138 |
| 4,825,892 | A | | 5/1989 | Norman | |
| 4,858,634 | A | | 8/1989 | McLeese | |
| 5,056,172 | A | * | 10/1991 | Kaiser et al. | 5/417 |
| 5,137,044 | A | | 8/1992 | Brady | |
| 5,249,592 | A | | 10/1993 | Springer et al. | |
| 5,370,145 | A | * | 12/1994 | Wu | 135/127 |
| 5,439,017 | A | | 8/1995 | Brown | |
| 5,440,762 | A | | 8/1995 | Schill | |
| 5,519,965 | A | | 5/1996 | Robinson | |
| 5,676,168 | A | | 10/1997 | Price | |
| 6,109,282 | A | | 8/2000 | Yoon | |
| 6,302,127 | B1 | | 10/2001 | Gayton | |
| 6,305,396 | B1 | * | 10/2001 | Zheng | 135/126 |
| 6,325,086 | B1 | | 12/2001 | Shinner et al. | |
| 6,328,049 | B1 | | 12/2001 | Kim | |
| 6,357,462 | B1 | * | 3/2002 | Laosunthara et al. | 135/96 |
| 6,500,111 | B1 | | 12/2002 | Salmon et al. | |
| 6,510,565 | B1 | * | 1/2003 | Zwezdaryk | 4/531 |
| 6,851,136 | B2 | * | 2/2005 | Brereton | 5/102 |
| 2002/0020439 | A1 | * | 2/2002 | Tate | 135/124 |
| 2002/0179133 | A1 | * | 12/2002 | Abbinante | 135/124 |
| 2004/0168715 | A1 | * | 9/2004 | Wang | 135/124 |
| 2005/0092355 | A1 | * | 5/2005 | Hsu | 135/125 |

* cited by examiner

*Primary Examiner*—Peter M. Cuomo
*Assistant Examiner*—Noah Chandler Hawk
(74) *Attorney, Agent, or Firm*—Frost Brown Todd LLC

(57) ABSTRACT

A collapsible tent provides insect protection for infants such as less than a year old while being small and portable enough for use in many public spaces. Excellent ventilation and visibility are provided by mosquito and no-see-um blocking fabric formed into a dome-like shape. Flexible support rods cross one another at the apex of the tent and reside within arch-shaped fabric channels. A detachable or alternatively attached ground barrier completes the enclosure. For storage, the flexible support rods are brought adjacent to one another to form a flat arch-shape with the pair of proximate ends then coiled toward the other pair to form a small circular shape that is readily retained within this compact shape by a carrying pouch. When the tent is erected, the carrying pouch is attachable to the tent to serve as a sunshade. A hanging support inside the tent may be used to suspend infant toys.

20 Claims, 4 Drawing Sheets

PORTABLE BABY TENT

REFERENCE TO RELATED APPLICATIONS

The present application claims the benefit of U.S. provisional patent application Ser. No. 60/564,923 of the same title filed 22 Apr. 2004.

FIELD OF THE INVENTION

The present invention relates, in general, to portable cabanas and tents, and more particularly to such devices that provide protection for infants from insects and summer sun.

BACKGROUND OF THE INVENTION

There is an increasing awareness that flying insects pose a serious health risk, rather than being merely an annoyance. With the spread of mosquito-borne diseases, such as West Nile virus in temperate regions, parents are seeking ways to protect young children and infants. While insect repellants are often used, the more effective formulations with DEET used by adults are not recommended for children. That is especially true for infants who are prone to suck on surfaces that may be sprayed with repellants.

Many insect protective barriers are known to screen in beds and cribs from mosquitoes. In addition, ever lighter and more easily erected camping tents are available that are well ventilated yet block insects. However, there are instances where these generally known insect barriers are too inconvenient to be used. For instance, at an outside youth sporting event, such as soccer or baseball, parents and siblings are arrayed along the sidelines of a field. It would be inconvenient to carry and setup a camping tent just to protect children, even if the physical confines of the area would permit it.

Consequently, a significant need exists for an insect barrier to protect small children that is extremely portable and not too obtrusive for use in public spaces.

BRIEF SUMMARY OF THE INVENTION

The invention overcomes the above-noted and other deficiencies of the prior art by providing a tent formed largely of a mesh material that provides excellent ventilation while blocking flying insects such as mosquitoes. The tent is carried in a flat, coiled configuration that is easily carried. The tent is erected quickly by removing the tent from a pouch, whereupon its flexible support rods spring toward an arch shape, as constrained within the mesh fabric. Drawing the crossed support rods into a more perpendicular cross shape erects an open bottom tent that may be easily placed over a child seat.

In one aspect of the invention, a tent has a dome-like shape that is readily supported by a pair of crossed straight support rods that are flexed by and restrained within sewn channels that are transversely affixed to the mesh material. The ends of one support rod may be drawn toward respective ends of the other support rod to flatten the tent. Drawing the proximate pair of ends toward the other proximate pair of ends forms a roughly circular flat shape that is then inserted into a circular pouch for storing and transporting. A flat ground cloth is shaped to underlie the tent to further block insects that may be on the ground. Thereby, a tent may be quickly erected and placed over an infant seat while at a park to provide protection from insects.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above and the detailed description of the embodiments given below, serve to explain the principles of the present invention.

DETAILED DESCRIPTION OF THE INVENTION

Figure 1:
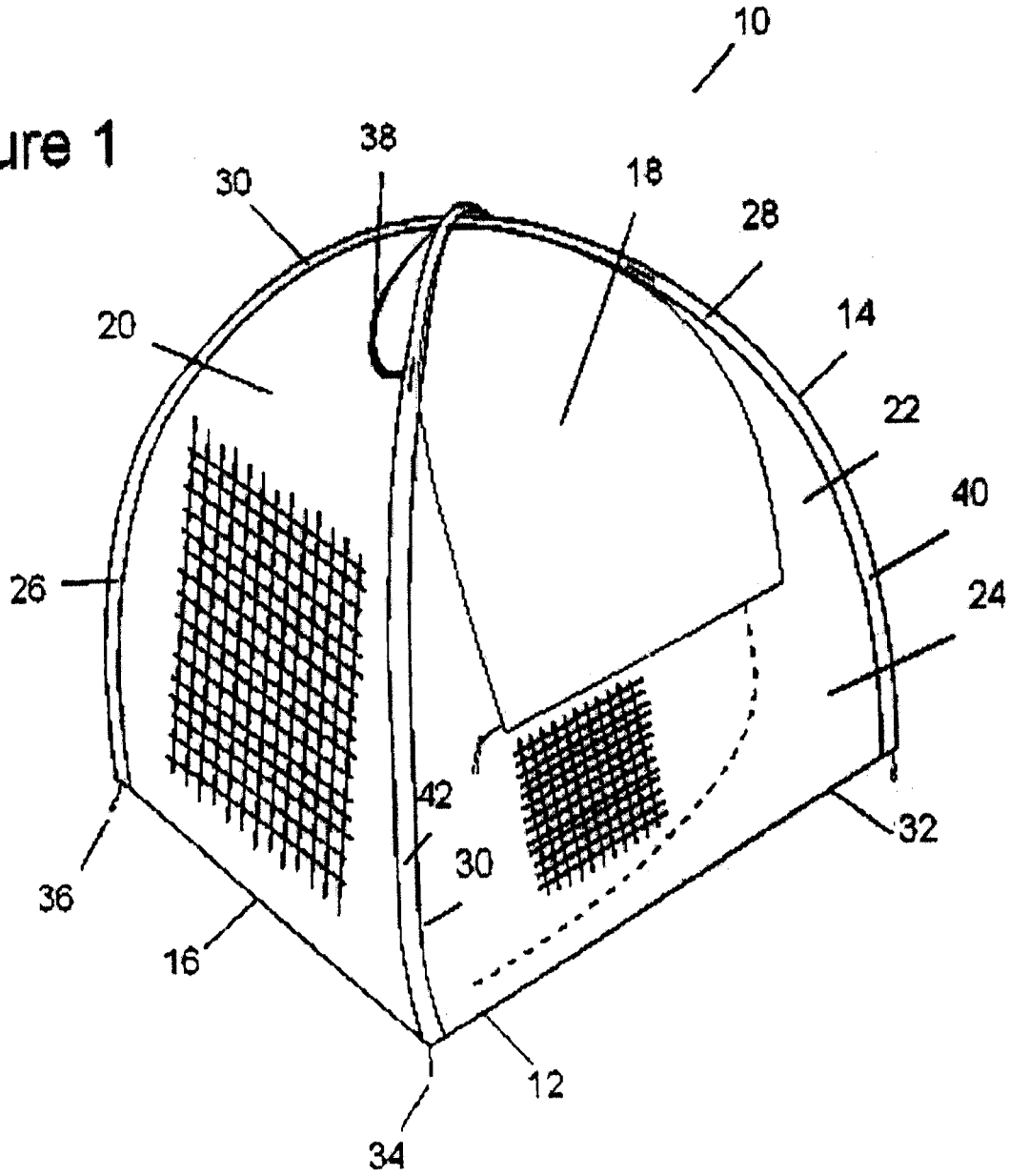
FIG. 1 is a top perspective view of a collapsible tent assembly for providing protection to infants from insects, including a ground barrier, an open bottom tent, and a carry pouch attachable to the tent for sun protection.

Turning to the Drawings, wherein like numerals denote like components throughout the several views, in FIG. 1, a collapsible tent assembly 10 is shown prepared to receive an infant seat (not shown). In particular, a ground barrier 12 has been unfolded and placed upon the ground to act as a barrier to moisture, dirt and insects. A collapsible tent 14 has been erected into its dome-like shape with its rectangular open bottom 16 sitting upon the ground barrier 12. A carrying pouch 18 from which the collapsible tent 14 and ground barrier 12 have been taken may be conveniently attached to the collapsible tent 14 to prevent its being misplaced as well as providing an adjustable sun shade for a protected infant.

The collapsible tent 14 includes four mesh fabric side panels 20–26 that allow ventilation and visibility while blocking insects, thereby, not distressing the protected infant. A pair of sewn fabric channels 28, 30 transverse to one another, pass from opposite bottom corners across the top of the collapsible tent 14, each of the pair 28, 30 having an arch shape. A bottom band 32 of like material forms a square shape connecting these four bottom corners. Ties 34 on the collapsible tent and ties 36 on the ground barrier 12 allow an enclosed space to be formed on uneven ground where otherwise a space may exist therebetween. The ties 34, 36 may comprise instead paired snaps, Velcro attachments, or be omitted. Inside of the collapsible tent 14 attached to its apex is a hanging attachment 38 that may be used to support infant toys (not shown) to amuse the protected infant.

Figure 2:
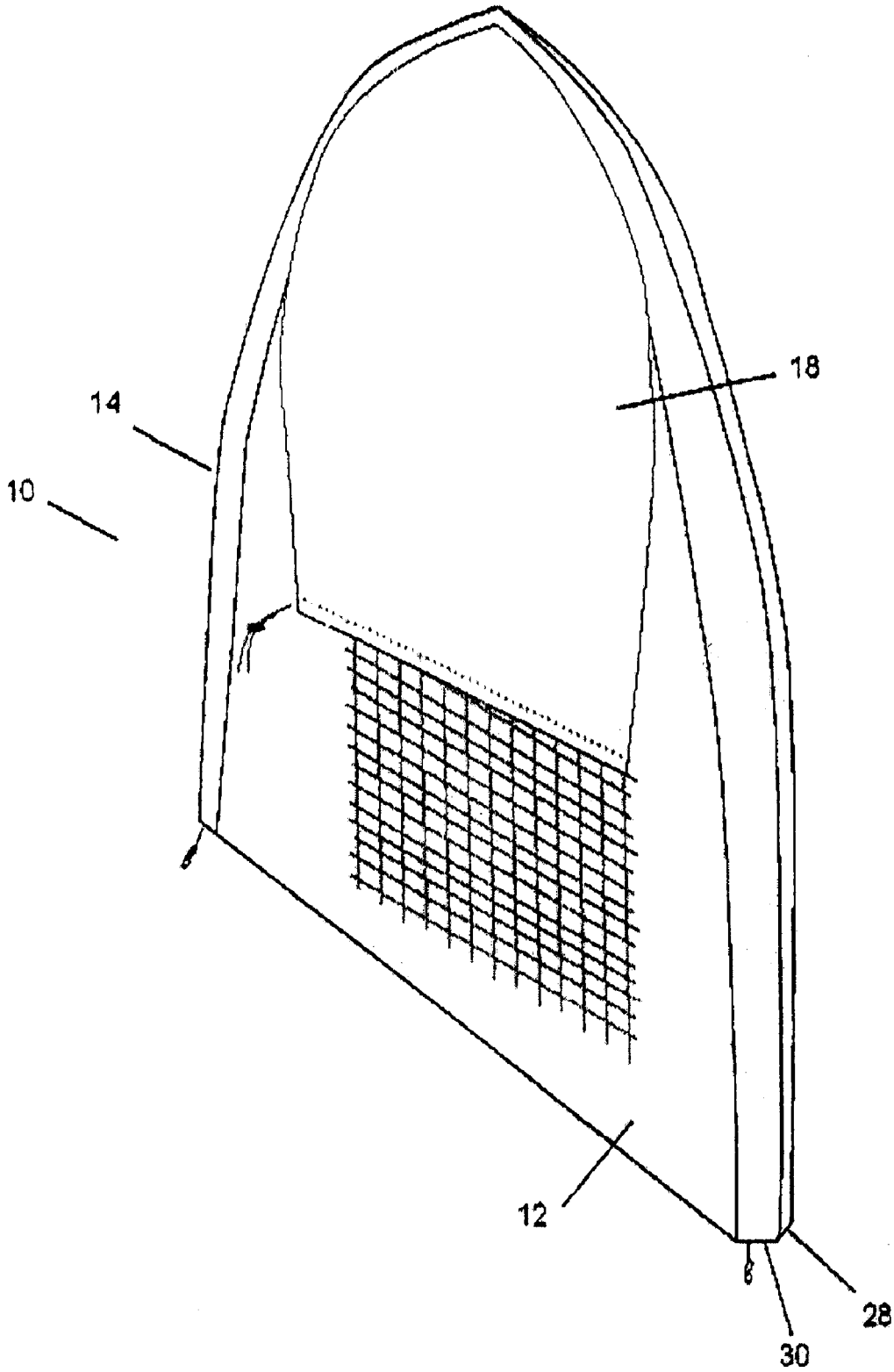
FIG. 2 is a perspective view of the collapsible tent assembly of FIG. 1 after the tent has been collapsed.
Figure 3:
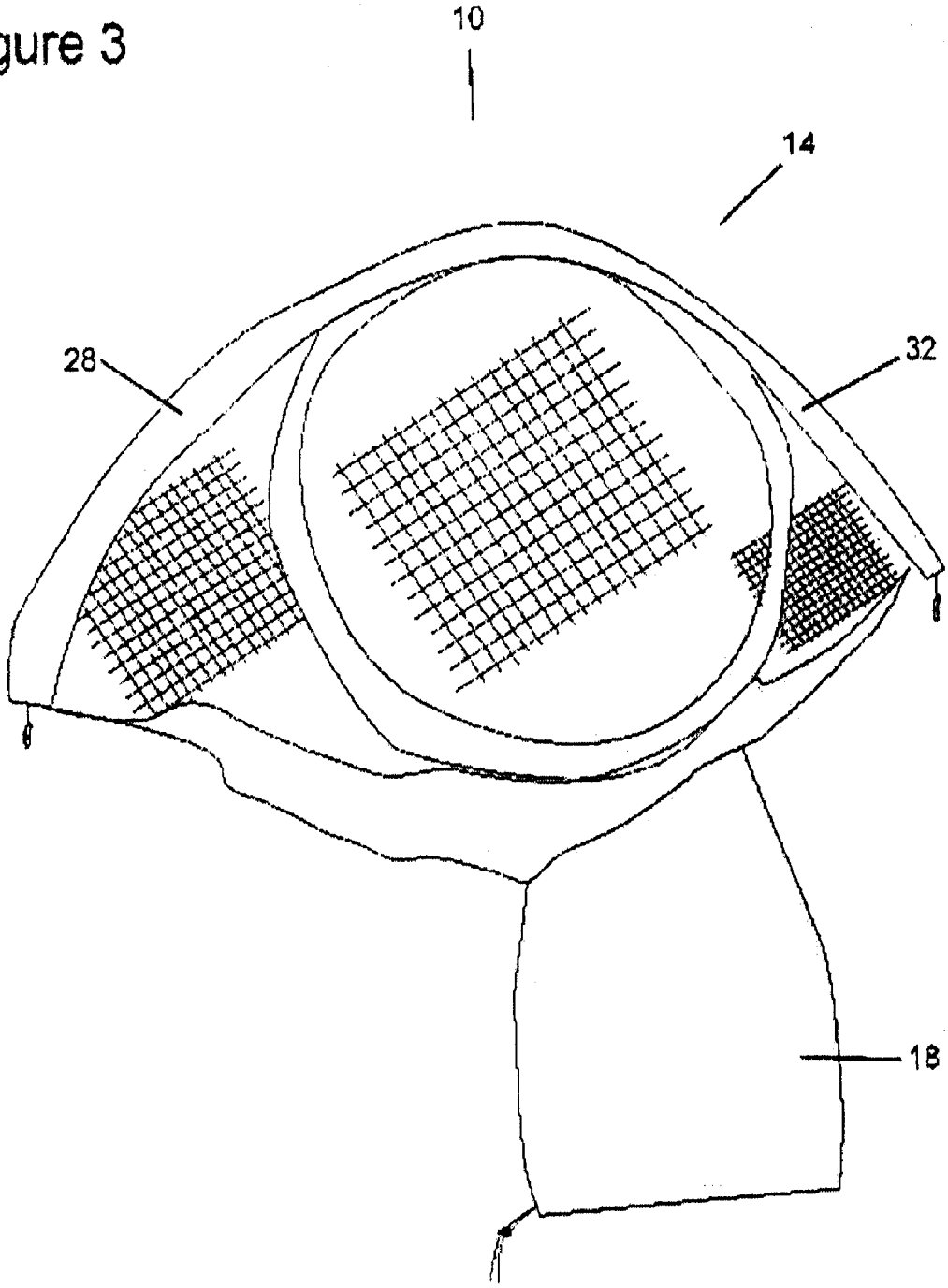
FIG. 3 is a perspective view of the collapsed tent of FIG. 2 after having been led into a small circular shape.
Figure 4:
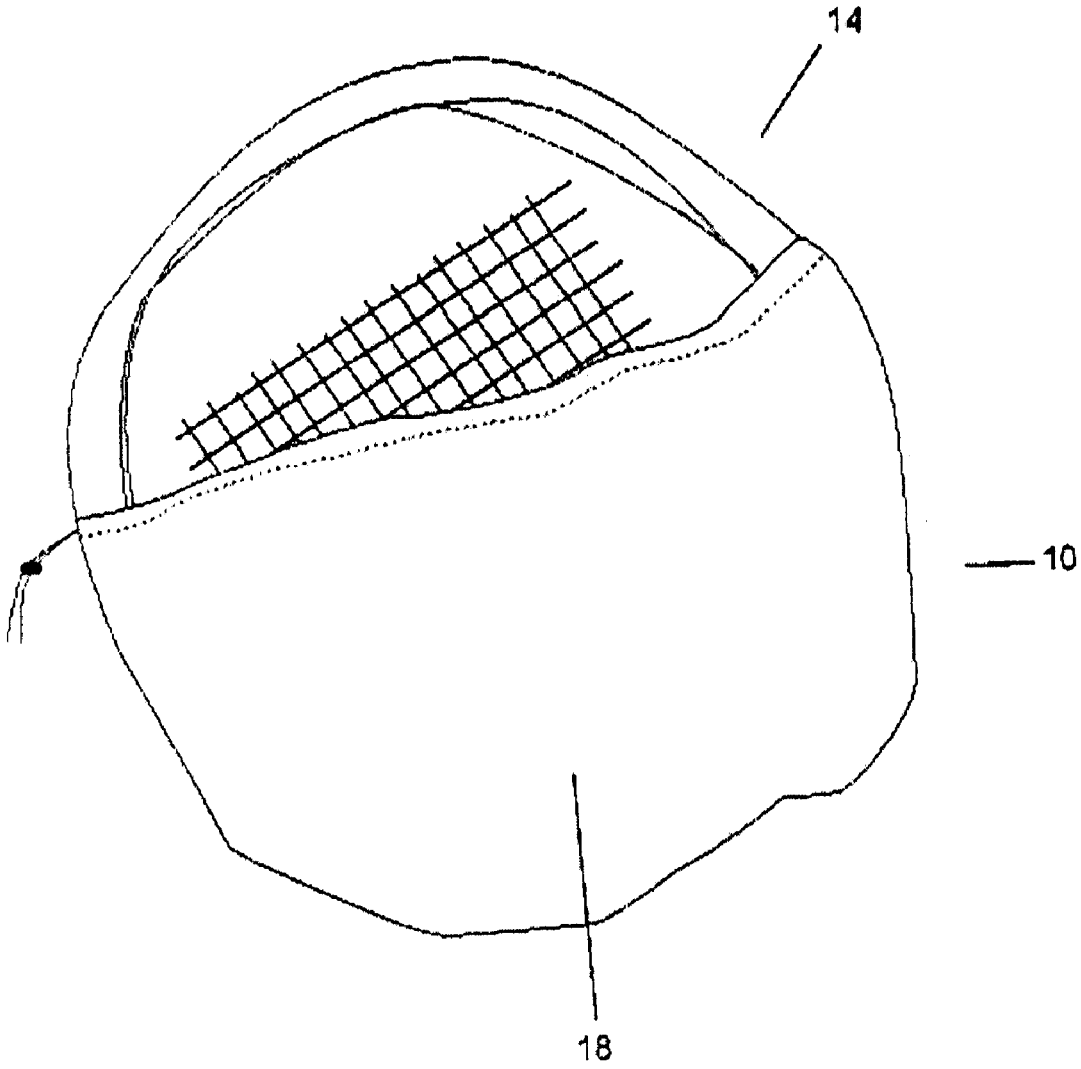
FIG. 4 is a perspective view of the coiled tent being placed in the carry pouch.

A pair of straight, flexible support rods 40, 42 reside within and are constrained by respective ones of the pair of sewn fabric channels 28, 30. Being unconnected but merely passing by the other at the top of the collapsible tent 14, a parent may fold the collapsible tent 14 into a flat, arch-like shape as depicted in FIG. 2 by drawing the transversely positioned support rods 40, 42 into an adjacent alignment. By further coiling the support rods 40, 42 to form a small circular shape, as depicted in FIG. 3, the collapsible tent 14 may be readily inserted into the carrying pouch 18 for storage or transporting.

As an illustrative version of the collapsible tent assembly 14, the support rods 40, 42 may be fabricated from flexible oil tempered spring steel (e.g., 0.0915 OTNB) or fiberglass that reside within channels 28, 30 made of a grosgrain ribbon or 170 T polyester. The mesh fabric panels 20–26 may be formed from No-See-Um mosquito netting (NN01). The ground barrier 12 may be formed of nylon or 210 T polyester ripstop. The carrying pouch 18 may be formed from polyester or nylon fabric.

As an alternative to having an open bottom tent 14 with a detachable ground barrier 12, the ground barrier 12 may be attached to the tent 14, further simplifying assembly and providing greater assurance of insect protection. A closable opening, such as a flap or slit that may be sealed with attaching means (e.g., Velcro, snaps, zipper, S-hook/fabric loop, etc.) may be provided on at least one panel 20–26 to provide access to the interior of the tent 14. Such a slit may be a vertical slit or an inverted-J shaped opening.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For example, since the tent 14 may be readily lifted and replaced, the tent 14 may also serve to protect picnic food from insects.

As another example, a permanent sunshade portion may be incorporated into the tent 14 so that the carrying pouch 18 need not be used. This may be particularly important in versions consistent with aspects of the invention where the tent 14 is open bottomed and may be readily rotated to maintain shade on the protected infant. It may be further appropriate in embodiments wherein integral fasteners on the tent 14 are included to maintain the tent in a coiled shape for storage and transport without having to use a carrying pouch 18.

What is claimed is:

1. A tent, comprising:

four triangular panels formed from an insect blocking fabric arranged into a dome-like shape having a square bottom forming an insect blocking barrier;

a pair of flexible support rods having ends attached at opposite bottom corners of the dome-like shape and having crossed midpoints at an apex of the dome-like shape, wherein the support rods may be drawn adjacent to one another and wound into two overlaid coils for storing with overlapping ends forming a substantially reduced circumference smaller than a length of each one of the pair of flexible support rods said overlapping ends being unattached when coiled in a closed postion; and a carrying constraint operably configured to maintain the support rods in an adjacent and coiled configuration of reduced circumference.

2. The tent of claim 1, wherein the carrying constraint comprises a carrying enclosure having an opening.

3. The tent of claim 2, further including an attachment mechanism operably configured to attach the carrying enclosure to the insect blocking barrier when erected for acting as a sunshade.

4. The tent of claim 1, further including a ground barrier.

5. The tent of claim 4, wherein the ground barrier is attached to the bottom of the square bottom, wherein at least one of the four triangular panels includes a sealable opening.

6. The tent of claim 1, further including a hanging attachment interiorly disposed from an apex of the insect blocking barrier, the hanging attachment operatively configured to receive infant toys.

7. The tent of claim 1, wherein the support rods comprise fiberglass material.

8. The tent of claim 1, wherein the support rods comprise spring steel.

9. An infant tent, comprising:

an even numbered plurality of three-sided panels formed from an insect blocking fabric arranged into a dome-like shape;

a plurality of flexible support rods comprising one per two three-sided panels, each flexible support rod resiliently positionable between a coiled shape and a domed arc shape when erected;

for each pair of adjacent three-sided panels, an arcing tent support operatively configured to contain one end of a selected one of the plurality of flexible support rods with an opposite pair of adjacent three-sided panels including a communicating arcing tent support aligned to receive the other end of the selected flexible support rod, wherein the plurality of contained flexible support rods cross at an apex of the dome-like shape; and a carrying bag operably configured to maintain the support rods in an adjacent and coiled configuration;

wherein the tent is stored by drawing the flexible support rods while contained in the arcing tent supports into close parallel alignment and coiling the flexible support rods into a circular configuration with overlapping ends forming a reduced circumference smaller than a length of each one of the pair of flexible support rods, said overlapping ends being unattached when coiled in a closed position for insertion into the carrying bag.

10. The infant tent of claim 9, wherein the carrying bag includes an attachment feature operatively configured to temporarily attach the carrying bag to a selected side of the erected dome-like shape for sun shade.

11. The infant tent of claim 9, further comprising a tent floor shaped to close a lower opening of the dome-like shape.

12. The infant tent of claim 11, wherein the tent floor is removably attached to the dome-like shape via closures.

13. The infant tent of claim 9, further comprising a mobile attachment extending downward from the apex of the dome-like shape operatively configured to engage a baby toy.

14. An infant tent for protecting a baby from insects, comprising:

a fabric tent formed from an insect blocking material sized to encompass an infant in a portable infant carrier;

a plurality of resilient support rods attached inside of the fabric tent in a crossed arcing configuration to erect the fabric tent; and a tent storage container;

wherein the fabric tent with resilient support rods is configurable into a disc shape with coiled resilient support rods with overlapping ends by being wound into a plurality of overlaid coils forming a substantially reduced circumference smaller than a length of each one of the pair of resilient support rods and said overlapping ends being unattached when coiled in a closed position for insertion into the tent storage container.

15. The infant tent of claim 14, further comprising a removably attached ground floor and shaped to close an open bottom of the fabric tent.

16. The infant tent of claim 14, further comprising a ground floor attached to close the open bottom of the fabric tent, further comprising a closeable entrance in the fabric tent.

17. The infant tent of claim 14, further comprising an attachment feature for attaching the tent storage container to an exterior of the fabric tent for shade.

18. The tent of claim 2, wherein the carrying constraint comprising the carrying enclosure having the opening comprises a circular bag.

19. The tent of claim 18, wherein the circular bag is exteriorly attached to the apex of the dome-like shape, positionable to a selected side for providing shade.

20. The tent of claim 1, wherein at least one of the four triangular panels includes an inverted-J shaped opening.

* * * * *